United States Patent [19]

Wolfberg et al.

[11] 4,234,775

[45] Nov. 18, 1980

[54] MICROWAVE DRYING FOR CONTINUOUSLY MOVING WEBS

[75] Inventors: Larry B. Wolfberg; John Harper, both of Wichita, Kans.

[73] Assignee: Technical Developments, Inc., Wichita, Kans.

[21] Appl. No.: 934,417

[22] Filed: Aug. 17, 1978

[51] Int. Cl.[3] ..... H05B 6/78

[52] U.S. Cl. ..... 219/10.55 A; 34/1; 219/10.55 F; 219/10.55 M

[58] Field of Search ..... 219/10.55 F, 10.55 A, 219/10.55 R; 34/1

[56] References Cited

U.S. PATENT DOCUMENTS

| | | | |
|---|---|---|---|
| 2,909,635 | 10/1959 | Haagensen | 219/10.55 F |
| 3,413,433 | 11/1968 | Timmermans et al. | 219/10.55 A X |
| 3,475,577 | 10/1969 | Gäde et al. | 219/10.55 A |
| 3,705,283 | 12/1972 | Sayer, Jr. | 219/10.55 A |
| 3,742,394 | 6/1973 | Van Koughnett et al. | 219/10.55 A |
| 3,757,070 | 9/1973 | Van Koughnett et al. | 219/10.55 A |
| 3,909,754 | 9/1975 | Chapell | 219/10.55 F |

*Primary Examiner*—Arthur T. Grimley

*Attorney, Agent, or Firm*—Schmidt, Johnson, Hovey & Williams

[57] ABSTRACT

In the use of microwave energy to remove moisture from a moving web, such as that moisture contained within transverse glue lines between superimposed sheets of the web for the purpose of holding the sheets together, the web is passed through a serpentine wave guide having a number of serially connected sections spanning the path of travel of the web. The microwave energy takes the form of standing waves within the wave guide, and the peaks of such waves represent "hot spots" of energy concentrations at which points maximum molecular agitation of the moisture is obtained so as to likewise obtain maximum drying effect. If the standing waves are simply tuned until resonance occurs, there is a considerable likelihood that the wave peaks of one section of the wave guide may become lined up with those of the other wave guide sections, hence producing several distinct lines of energy concentrations along the path of web travel. To counteract this and distribute the drying effects of the microwave energy over substantially the full width of the moving web, various alternative means are provided for disrupting the standing wave pattern so as to cause the peaks to oscillate along the guide sections and thereby continuously change the random location of the peaks.

12 Claims, 19 Drawing Figures

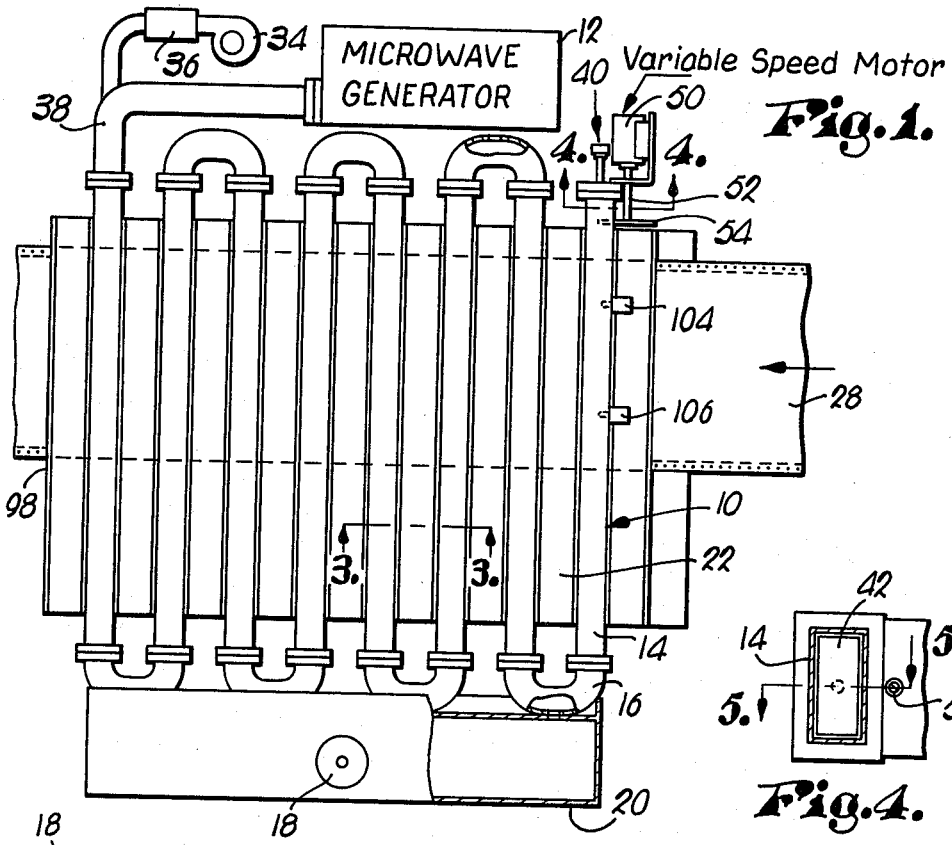
Fig. 1.
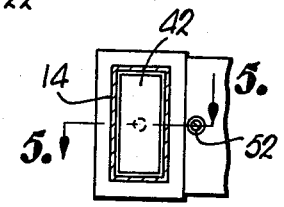
Fig. 4.
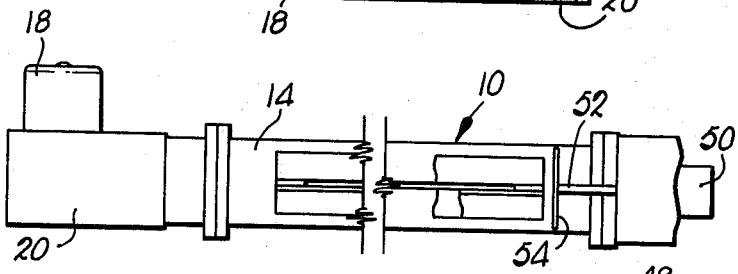
Fig. 2.
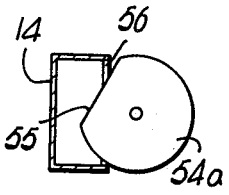
Fig. 6.
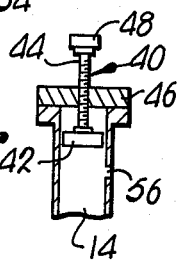
Fig. 5.
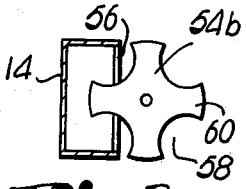
Fig. 7.
Fig. 3.
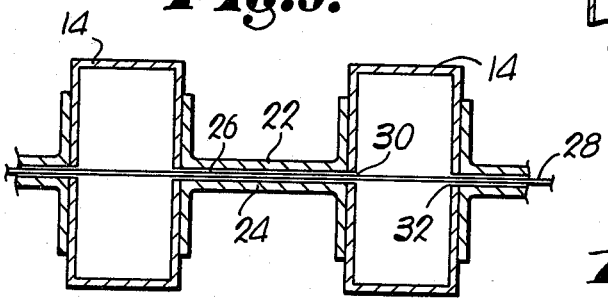
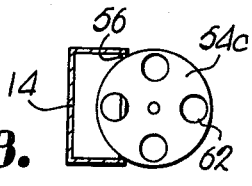
Fig. 8.

MICROWAVE DRYING FOR CONTINUOUSLY MOVING WEBS

TECHNICAL FIELD

This invention relates to microwave drying techniques and has particular utility for use in connection with the manufacture of continuous business forms and the like having crossweb glue lines that must be rapidly dried in order to produce multi-leaved business forms of the highest quality.

BACKGROUND ART

Many significant advances in the art of microwave drying have been described and claimed in several prior patents assigned to the assignee of the present invention. Among these, for example, are U.S. Pat. Nos. 3,707,773, titled "Multi-Line Gluing of Superimposed Leaves," and 3,756,889, titled "Glue Fastening of Superimposed Leaves." These prior patents discuss some of the more difficult problems encountered in the production of fine-quality, multi-leaved business forms and, to a certain extent, the solutions set forth in said patents to the problems are relevant to the invention herein described and claimed. However, as will be apparent as the present description proceeds, the principles of the present invention are not limited to use in connection with the production of business forms or to the drying of glue lines, whether used in connection with business forms or not. Rather, the principles herein have wide-ranging utility and may be applied in such situations, for example, where it is necessary to dry ink on continuously moving webs so that the webs can be folded or otherwise handled immediately after printing without running the risk of smearing the ink. Hence, it should be kept in mind throughout the description which follows that the illustration in the drawings of a multi-leaved business form having glue lines which must be dried, and the use of such business forms in the description which follows, are by way of example only.

It is known in the art to utilize a serpentine or "meandering" wave guide in connection with microwave drying. Such installations provide the wave guide with a plurlity of serially interconnected guide sections that extend across the path of travel of the moving web and are adapted to expose the web to the microwave energy within the various sections as the web progressively advances from one end of the guide to the other. Hence, a leading part of the web is exposed not only to the microwave energy within the first encountered guide section, but also to that within the subsequently encountered guide sections, thereby prolonging the overall exposure of the web to microwave energy and hence promoting rapid drying. It has been found, however, that it is not unusual for the standing waves produced within the guide sections to orient themselves in such a way that the several wave peaks in each section are aligned with corresponding wave peaks in the other sections, thereby forming lines of wave peaks extending longitudinally of the web and spaced apart according to the frequency being utilized. Such wave peaks represent points of maximum energy, and hence it might be thought of as the peaks presenting "hot spots" which can be applied to the moving web for drying purposes. When such hot spots are lined up in the aforesaid manner, the areas between the spots remain virtually unaffected, to the end that uneven drying across the width of the web can result.

This is particularly significant where the web being dried consists of a multi-leaved business form or a series of interconnected, snap-out envelopes which require crossweb glue lines as opposed to glue lines only along the longitudinal edges of the moving web. It can be appreciated that if microwave energy is applied only to certain spots along the crossweb glue lines, the glue line will be unevenly dried, leading to the serious problem of "tenting" that arises adjacent the cross-perforation lines in the web where folding is to occur. Such tenting consists in the separation of leaves at the line of fold, forming a small triangular bulge that simply cannot be tolerated because of the resulting malfunction of the high-speed folding equipment with which such webs are utilized.

SUMMARY OF THE INVENTION

According to the present invention, the standing waves of the wave guide are purposely disrupted so as to cause the peaks thereof to continuously oscillate along the various sections. By constantly moving the wave peaks in this manner, there is no opportunity for the peaks of one guide section to come into stationary alignment with the peaks of other guide sections, hence resulting in more uniform application of the microwave energy across the width of the web as it moves through the entire length of the wave guide.

The particular structure for accomplishing such agitation or disruption of the standing waves can take several different forms including, for example, a reciprocating "tuning" plunger adjacent the end of the wave guide opposite the magnetron generator, a partition which is reciprocated into and out of one of the guide sections to periodically open up and close off the section behind the partition, and several forms of rotating dielectric discs whose peripheries travel in arcuate paths of travel that pass into and out of the selected wave guide section.

Also of significance is a related discovery that the serpentine-type of wave guide associated with the present invention is not limited to use in situations where the energy is to be distributed more evenly across the full width of the web, but can instead be utilized even in situations where lines of concentration of the microwave energy are desired such as where longitudinal glue lines in the web are presented for drying. In this situation, it is desirable not to disrupt the standing waves so as to oscillate the energy peaks thereof. To the contrary, it is desirable to "tune" the system such as to place the peaks of one guide section in line with those of another so as to produce the lines of energy peaks purposely avoided with respect to whole web drying. The problem, however, is in locating these peaks precisely over the longitudinal glue lines that are to be dried, and one way of achieving this end is to utilize portable energy level probes that can be adjusted along the length of one of the guide sections and set in positions corresponding to the locations of the glue lines across the width of the web. Such probes will provide a humanly perceivable signal when the wave peaks are in line and in registration with the probes, thereby permitting the operator to adjust the tuning structure until such time as the probes indicate that the energy peaks have been located at the selected positions.

BRIEF DESCRIPTION OF THE DRAWINGS

FIG. 1 is a top plan view of a drier constructed in accordance with the principles of the present invention and capable of carrying out our novel method;

FIG. 2 is an end elevational view thereof taken at the entrance end;

FIG. 3 is an enlarged, fragmentary cross-sectional view through the serpentine wave guide taken substantially along line 3—3 of FIG. 1;

FIG. 4 is an enlarged, fragmentary, cross-sectional view of the "tuning" end of the wave guide taken substantially along line 4—4 of FIG. 1;

FIG. 5 is an enlarged, fragmentary cross-sectional view of the tuning plunger for the wave guide taken substantially along line 5—5 of FIG. 4;

FIGS. 6, 7 and 8 are fragmentary, cross-sectional views of various alternative structures for disrupting the standing wave pattern within the wave guide;

DETAILED DESCRIPTION

Figure 11:
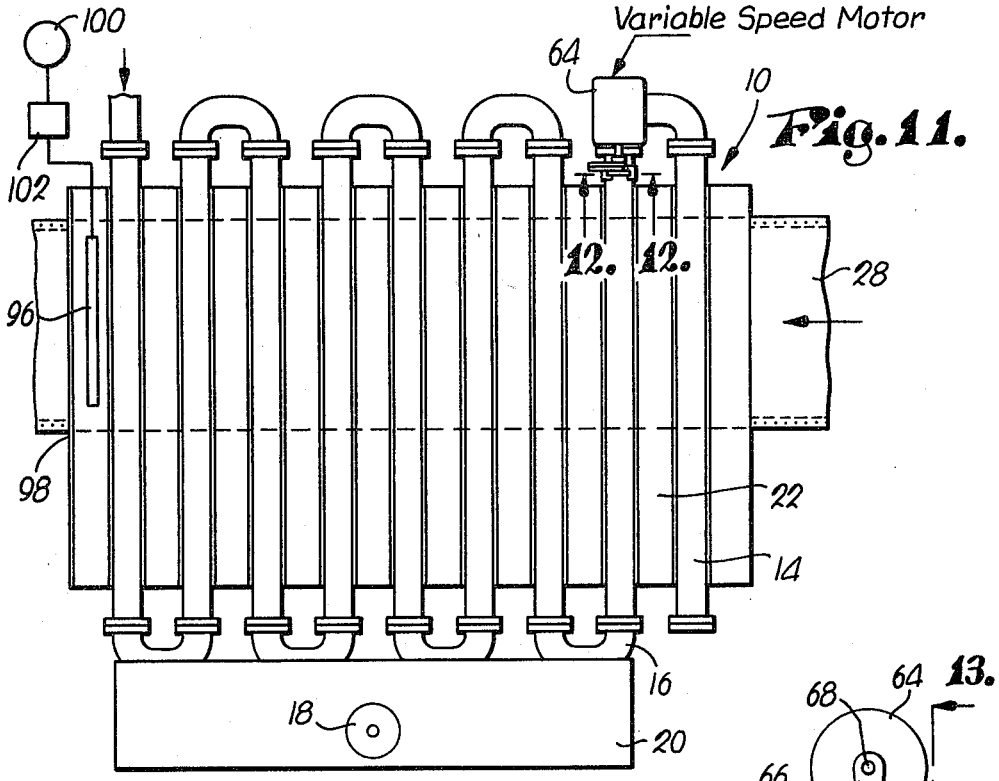
FIG. 11 is a top plan view of the drier similar to FIG. 1, but showing yet another alternative embodiment for disrupting the standing wave pattern, this alternative involving a reciprocating partition.

The drier as illustrated in FIG. 1 includes an elongated wave guide 10 that is adapted for conducting electrical energy in the microwave region as generated by the generator 12. The wave guide 10 is serpentine in nature, having a plurality of serially interconnected guide sections 14, there being a generally U-shaped connector 16 joining adjacent ends of successive ones of the guide sections 14. An exhaust fan 18 connected to a manifold 20 that communicates with each of the guide sections 14 draws off moisture-laden air produced during the drying process.

The guide sections 14 are tubular in nature and have a rectangular cross section as illustrated in FIG. 3. Slightly spaced-apart, superimposed plates 22 and 24 bridge the gap between adjacent ones of the guide sections 14 and provide a sealed passageway 26 for a moving web 28. Aligned slots 30 and 32 on opposite sides of each guide section 14 extend transversely of the path of travel of the web 28 and are in registration with the passageway 26 so as to provide for movement of the web 28 through the wave guide 10 transversely of the sections 14.

Adjacent the generator end of the wave guide 10, a fan 34 draws in ambient air and passes the same through a heating coil 36, whereupon the air is directed into the conduit 38 coupled with the proximal end of the adjacent guide section 14. Hot, dry air is thus circulated throughout the wave guide 10 to assist in the drying process in a manner as will be hereinafter described. At the opposite end of the wave guide 10, a tuning plunger 40 is located for the purposes of adjusting the locations of the standing waves produced within the wave guide 10 by the generator 12.

As illustrated perhaps best in FIGS. 4 and 5, the tuning plunger 40 has a rectangular head 42 rotatably connected to a threaded shank 44 that extends axially of the guide section 14 through a cap 46. The bore which receives the shank 44 in cap 46 is matingly threaded such that rotation of the shank 40 via a knob 48 on the outer end thereof causes the head 42 to be shifted inwardly or outwardly depending upon the direction of rotation of the shank 44, the free pivotal connection of the shank 44 with the head 42 permitting the shank 44 to rotate without likewise causing rotation of the rectangular head 42 within the rectangular guide section 14.

Also adjacent the end of wave guide 10 opposite the generator 12 is a variable speed motor 50 having an output shaft 52 extending alongside of the adjacent guide section 14 in parallelism therewith. A disc 54, preferably of dielectric material, is fixed to the shaft 52 at the outer end thereof for rotation therewith partially into the adjacent guide section 14 through a lateral aperture 56. As illustrated in FIGS. 6, 7, and 8, the disc 54 may take several different forms. In FIG. 6, the disc 54*a* is generally circular but has an irregular periphery as a result of the flat 55 along one portion thereof. Note that rotation of the disc 54*a* results in varying portions of the guide section 14 being open and exposed, depending upon the position of the flat 56 at any particular point in time.

FIG. 7 shows a disc 54*b* having a series of arcuate cutouts 58 spaced equally about the periphery thereof between radially extending solid portions 60. As is apparent, rotation of the disc 54*b* results in the portions 60 and the cutouts 58 alternately coming into the guide section 14 such as to affect the standing wave pattern.

FIG. 8 shows a disc 54*c* which includes a series of perforations 62 equally spaced about the circumference thereof but inwardly of the outer periphery thereof. Again, the alternating solid surface and perforations presented to the standing waves within the section 14 results in substantial disruption. In all three embodiments of FIGS. 6, 7, and 8, the variable speed motor permits adjustment of the speed of rotation of the discs according to the particular characteristics of the web 28 being processed.

FIG. 11 shows another alternative to the rotating dielectric disc 54. In this figure, a variable speed motor 64 has a crank 66 attached to its output shaft 68 so as to operate a pitman rod 70. The motor 64 is situated above one of the sections 14 other than the last section 14 in the series and, through cranks 66 and 70, drives a partition 72 into and out of a slot 74 in the adjacent guide section 14, thereby alternately opening and closing the next adjacent and last guide section 14. As with the arrangement of FIG. 1 and FIGS. 6, 7, and 8, such alternating presence of the partition 72 has the effect of disrupting the standing wave pattern within the entire wave guide 10. Once again, by virtue of the fact that the motor 64 is indeed of the variable speed type, adjustments can be made in the frequency of insertion of the partition 72 as may be required from time to time depending upon the particular characteristics of the web 28 being processed.

Figure 9:
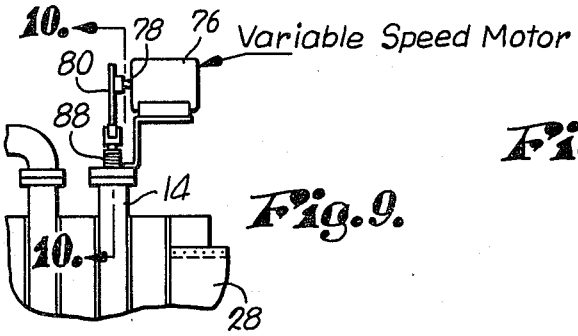
FIG. 9 is a fragmentary plan view of another embodiment for disrupting the standing wave pattern, such alternative embodiment relating to means for reciprocating the tuning plunger.
Figure 10:
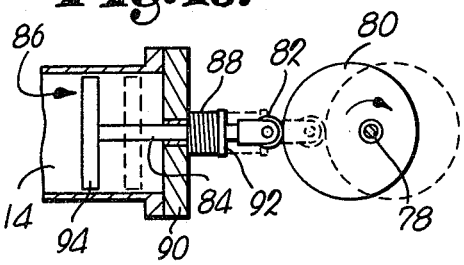
FIG. 10 is an enlarged, fragmentary cross-sectional view of the reciprocable tuning plunger of FIG. 9 and taken substantially along line 10—10 of FIG. 9.

FIGS. 9 and 10 relate to another form of structure for disrupting the standing wave pattern within the wave guide 10. To this end, a variable speed motor 76 has its output shaft 78 connected eccentrically to a cam 80 operating a cam follower 82 associated with the shank 84 of tuning plunger 86. A coil spring 88 between the cap 90 and a collar 92 on the shank 84 yieldably biases the follower 82 toward and in engagement with the cam 80 such that upon rotation of the latter, the head 94 of the plunger 86 is reciprocated between the solid and dotted line positions shown in FIG. 10.

As illustrated in FIG. 11, a pyrometer-type of probe 96 may optionally be provided adjacent the web discharge end 98 of the wave guide 10 for the purpose of reading the temperature of the dried web 28 as it leaves the wave guide 10. The thermocouple readout of such probe 96 may be connected to a warning device 100 via an intermediate signal-producing component 102 so that the operator would be advised if the temperature of the web issuing from the wave guide 10 was above or below predetermined levels.

Returning momentarily to FIG. 1, a pair of portable energy level probes 104 and 106 may be utilized in connection with any one of the guide sections 14. Such probes project into suitable slots (not shown) in the section 14 and may be adjusted along the length of the latter to any one of a number of selected positions corresponding, for example, with longitudinal glue lines on the web 28. The probes 104 and 106 would consist of germanium/silicone diodes designed for microwave frequency, the DC voltage output of which may be connected to a transistorized amplifier to actuate a meter to show when the energy peaks of the standing waves within the guide section 14 are in registration with the probes 104 and 106.

Figure 14:
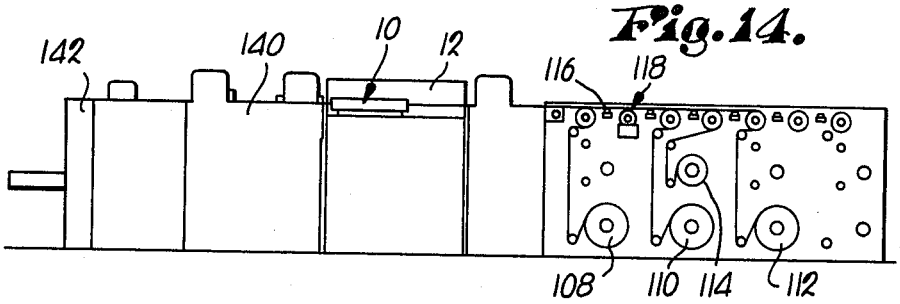
FIG. 14 is a side elevational view of equipment with which the principles of the present invention may be used.
Figure 15:
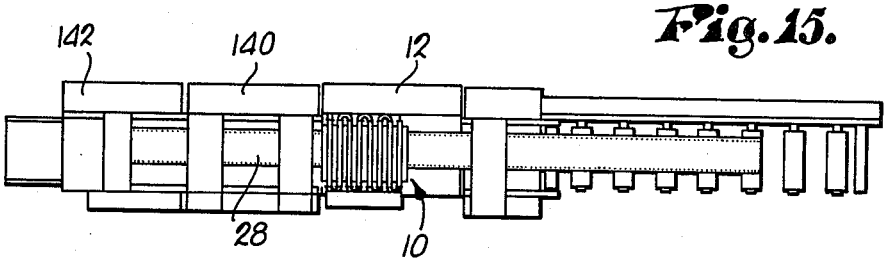
FIG. 15 is a top plan view thereof.
Figure 18:
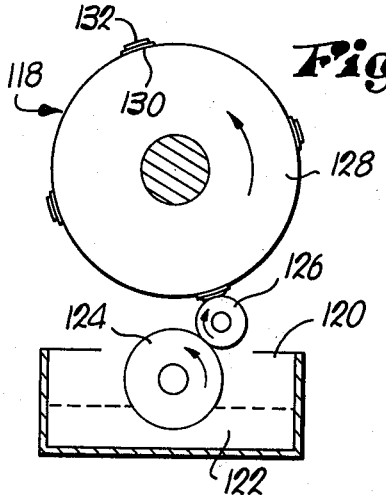
FIG. 18 is a transverse, fragmentary cross-sectional view on a schematic basis of another type of glue-applying apparatus useful in connection with the application of crossweb glue lines.
Figure 19:
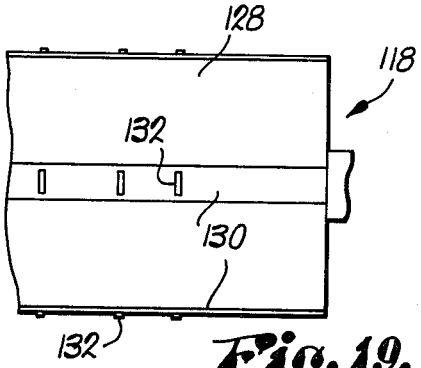
FIG. 19 is a fragmentary plan view of the aplicator roller of the apparatus in FIG. 18.
Figure 17:
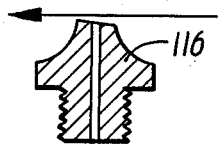
FIG. 17 is an enlarged, detail view of one type of glue applicator used on the equipment of FIGS. 14 and 15.
Figure 16:
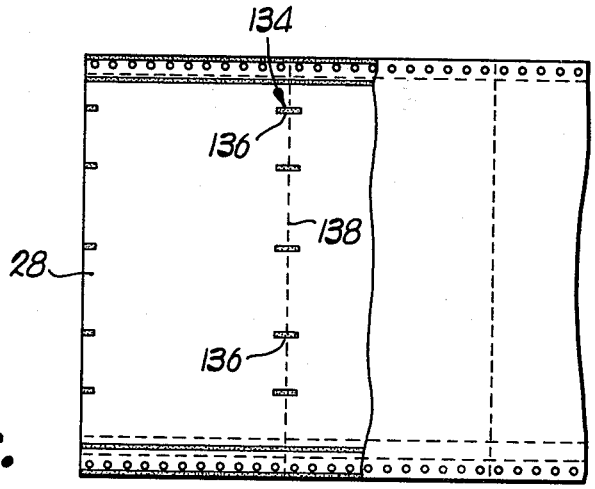
FIG. 16 is an enlarged, fragmentary top plan view of a sample business form which may be run through the drier of the present invention.

Referring now to FIGS. 14 and 15, exemplary equipment is illustrated for using the serpentine wave guide 10 of the present invention. By way of example, the equipment shown is capable of manufacturing a web of superimposed leaves of material from three separate rolls of material 108, 110 and 112, such materials cooperating to form the web 28 as illustrated in more detail in FIG. 16. If desired, a carbon roll 114 may also be utilized. A series of glue applicators 116 (shown in detail in FIG. 17) may be located along opposite longitudinal edges of the web 28 for the purpose of applying continuous longitudinal glue lines if such is desired. Alternatively, or in conjunction with the applicators 116, applicators 118 may be utilized for producing crossweb glue lines. As illustrated in FIG. 18, such applicators 118 may include a receptacle 120 for the glue 122, a pickup roller 124, a transfer roller 126 and an applicator roller 128 for receiving glue from the transfer roller 126. Longitudinally extending strips 130 spaced circumferentially about the applicator roller 128 are each provided with a series of applicator nibs 132 arranged according to the desired characteristics of the glue line to be applied. Note in this regard that the web 28 in FIG. 16 shows a transverse glue line 134 consisting of a series of individual glue smears 136, each of which extends across a perforation 138 where the web 28 will be folded.

The equipment of FIGS. 14 and 15 also includes a perforating head 140 downstream from the microwave drier, and further includes a folder section 142 for folding the web 28 in alternately opposite directions about the cross-perforations 138 at a high rate of speed.

The use of the various features hereinabove described should be readily apparent from the foregoing description. However, in order to avoid any likelihood of confusion, the following additional description of the operation will be set forth.

OPERATION

In setting up the wave guide 10 for operation, it must first be determined whether or not distribution of the available microwave energy over substantially the full width of the web 28 is desired, or whether it is preferable to produce lines of wave peaks coinciding with longitudinal glue lines on the web 28. Assuming initially that even-drying throughout the width of the web is desired, it is preferable to first adjust the plunger 40, which operates in the nature of a tuning choke, to locate the various energy peaks of the standing waves within the wave guide 10 at random locations throughout the latter. Thereupon, by actuating the variable speed motor 50 associated with the dielectric disc 54, the peaks of the standing waves will be agitated and caused to oscillate along the various sections 14 of the wave guide 10 so as to locate such energy peaks at truly random locations at any given point in time. Consequently, crossweb glue lines, including the intermittent type designated by the numeral 134 in FIG. 16, may receive the full effects of the microwave energy all along the lengths thereof over the full width of the web 28 such as to promote even-drying as the web 28 progressively encounters the successive guide sections 14 of the wave guide 10.

The above assumes that the embodiment of FIGS. 1–8 is to be utilized in which the tuning plunger 40 is adjustable, but not reciprocable, on a continuous basis, and one of the dielectric discs 54*a*, 54*b* or 54*c* is being utilized.

On the other hand, the embodiment of FIGS. 9 and 10 could, for example, be utilized. In this event, the tuning plunger 86 would not remain at any selected position, but would rather be continuously reciprocated by the cam 80 so as to disrupt the standing wave pattern.

Figure 12:
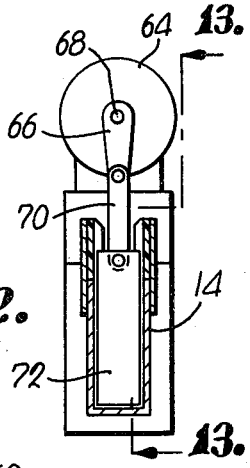
FIG. 12 is an enlarged, fragmentary cross-sectional view of the embodiment in FIG. 11 and taken substantially along line 12—12 of FIG. 11.
Figure 13:
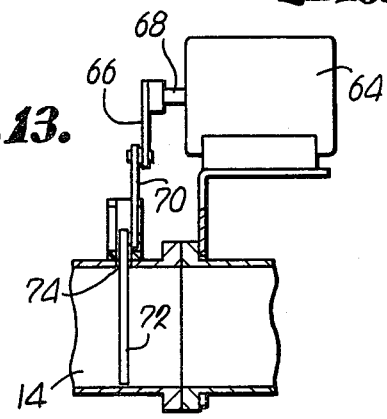
FIG. 13 is an enlarged, fragmentary cross-sectional view of the embodiment of FIGS. 11 and 12 taken substantially along line 13—13 of FIG. 12.

As a further alternative, the embodiment of FIGS. 11, 12 and 13 could be utilized in which event the partition 72 is slipped into and out of the guide section 14 to effectively open up and block off the last guide section 14 of the series thereof, hence disrupting the standing wave pattern.

Regardless of which embodiment is chosen, the agitation imparted to the peaks of the energy waves provides the same effect, i.e., distributing the energy effectively over the full width of the web by the time the web reaches the final discharge end 98 of the wave guide 10.

If instead of uniform drying over the full width of the web the operator desires to concentrate the source of energy at locations inboard of the two longitudinal edges of the web, the structure for disrupting the standing waves may be disabled by suitable means so as not to affect the pattern of the standing wave peaks. Thereupon, the portable energy level probes 104 and 106 may be set at selected locations along the supporting guide section 14 in accordance with longitudinal glue lines or the like on the web 28 moving therebeneath. Adjustment of the tuning plunger 40 to bring a pair of energy peaks underneath the probes 104 and 106 will indicate that other energy peaks are likewise aligned with the probes 104 and 106 such that the operator may proceed with running the web 28 without wasting a large amount of footage through trial and error in an effort to promptly locate the energy peaks for best drying of the lines.

Although the foregoing has been set forth with respect to the production of business forms, as earlier stated, the principles of the present invention are not limited to such products. For example, it is not unlikely that the present invention might be utilized in connection with a printing press to dry the inks on the moving web, such drying being a considerable problem, particularly on multicolor presses. When the roll of paper is rewound at the end of the machine, there is always the possibility of transferring semidry ink, and hence the entire job is spoiled. With full and complete drying using the serpentine wave guide 10 of the present invention, such problems should not be encountered.

We claim:

1. A drier for removing moisture associated with a web advancing along a predetermined path of travel, said drier including:

an elongated wave guide adapted for conduction of electrical energy in the microwave region characterized by a series of standing waves, said wave guide having a plurality of serially interconnected sections extending back and forth across said path of travel, each of said sections having means permitting the passage of the moving web through the wave guide transversely of said sections;

a source of said electrical energy coupled with the wave guide for producing said standing waves;

a tuning device coupled with said wave guide and adapted for selective adjustment to tune the wave guide and the particular web associated therewith to the frequency of said source of electrical energy; and continuously moving means separate from said device and associated with said wave guide for continuously disrupting said standing waves at a selectively adjustable rate and causing the peaks thereof to oscillate along the various sections, thereby avoiding stationary alignment of the wave peaks in one section with those in another section to the end that the drying effects of the microwave energy are dispersed throughout the width of the web.

2. A drier as claimed in claim 1, wherein said tuning device is located at one end of said wave guide, said moving means being disposed between said source of energy and the tuning device.

3. A drier as claimed in claim 2, wherein said reciprocating means for the structure is adjustable to vary the speed of said reciprocation.

4. A drier as claimed in claim 1, wherein said moving means includes a partition shiftable into and out of one of said sections at a predetermined frequency and operable when within said one section to change the effective length of the wave guide.

5. A drier as claimed in claim 4, wherein said partition has variable speed drive means associated therewith for effecting said shifting at a selected frequency.

6. A drier as claimed in claim 1, wherein one of said sections is provided with a lateral aperture therein, said moving means including a member movable along a path of travel extending through said aperture, said member being configured to allow a passage of a varying portion of the waves as said moving of the member is carried out.

7. A drier as claimed in claim 6, wherein said member is mounted to effect said movement by rotation.

8. A drier as claimed in claim 7, wherein said member has an irregular periphery which causes the member to span a varying area of the one section during said rotation.

9. A drier as claimed in claim 7, wherein said member has a periphery provided with a regular series of cutouts.

10. A drier as claimed in claim 7, wherein said member is perforated at certain locations.

11. A drier for removing moisture associated with a web advancing along a predetermined path of travel, said drier including:

an elongated wave guide adapted for conduction of electrical energy in the microwave region characterized by a series of standing waves, said wave guide having a plurality of serially interconnected rectilinear and curvilinear sections extending back and forth across said path of travel, each of said rectilinear sections having means permitting the passage of the moving web through the wave guide transversely of said rectilinear sections;

a source of said electrical energy coupled with the wave guide for producing said standing waves;

structure defining an adjustable tuning choke at one end of the wave guide for selectively establishing the locations of the peaks of the waves along the rectilinear sections; and means for sensing the presence of said peaks and for providing a perceivable signal that indicates said presence, said sensing and signaling means being adjustably shiftable longitudinally along one rectilinear section of the wave guide so as to facilitate alignment of the wave peaks in said one rectilinear section with the wave peaks in the other rectilinear sections of the wave guide.

12. A method of drying moisture associated with a moving web, said method including the steps of:

passing the web through a chamber conducting electrical energy in the microwave region from a source of said energy;

adjustably tuning the chamber and the web passing therethrough to the frequency of said source of energy so as to locate the peaks of standing waves produced within the chamber at certain locations along the latter; and causing said wave peaks to continuously oscillate at an adjustable rate along the chamber in a direction transverse to the path of travel of the web, whereby to spread the drying effects of the microwave energy across the width of the web.

* * * * *